US010228202B2

(12) United States Patent
Jarboe

(10) Patent No.: US 10,228,202 B2
(45) Date of Patent: Mar. 12, 2019

(54) MAGAZINE WITH SPACERS FOR ACCOMMODATING MULTIPLE CALIBER, SIZE AND/OR LENGTH ROUNDS

(71) Applicant: RA Brands, L.L.C., Madison, NC (US)

(72) Inventor: Michael Brent Jarboe, Rineyville, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 15/487,793

(22) Filed: Apr. 14, 2017

(65) Prior Publication Data

US 2017/0307319 A1 Oct. 26, 2017

Related U.S. Application Data

(60) Provisional application No. 62/326,533, filed on Apr. 22, 2016.

(51) Int. Cl.

| | |
|---|---|
| ***F41A 9/71*** | (2006.01) |
| ***F41A 9/70*** | (2006.01) |
| ***F41A 9/79*** | (2006.01) |

(52) U.S. Cl.

CPC ..... *F41A 9/71* (2013.01); *F41A 9/70* (2013.01); *F41A 9/79* (2013.01)

(58) Field of Classification Search

USPC ..... 42/49.02, 50

See application file for complete search history.

(56) References Cited

U.S. PATENT DOCUMENTS

| | | | | |
|---|---|---|---|---|
| 1,407,633 | A * | 2/1922 | Burton | F41A 9/71 42/49.02 |
| 2,185,676 | A | 1/1940 | Moneta | |
| 2,296,729 | A * | 9/1942 | Mossberg | F41A 9/71 42/49.02 |
| 2,597,746 | A | 5/1952 | Mulno | |
| 2,659,173 | A | 11/1953 | Capito | |
| 2,719,375 | A | 10/1955 | Crittendon et al. | |
| 2,895,248 | A * | 7/1959 | Sawin | F41A 9/71 42/18 |
| 3,399,480 | A | 9/1968 | Rowe, Jr. | |
| 3,779,131 | A | 12/1973 | Kawamura | |
| 3,913,251 | A | 10/1975 | Browning | |

(Continued)

FOREIGN PATENT DOCUMENTS

| | | |
|---|---|---|
| CA | 2537304 C | 3/2012 |
| EP | 1847793 A2 | 10/2007 |

(Continued)

*Primary Examiner* — John Cooper

(74) *Attorney, Agent, or Firm* — Womble Bond Dickinson (US) LLP

(57) ABSTRACT

A magazine for a firearm can have a housing defining a cavity with a biased follower arranged therein. The magazine may be configured to be received within a magazine well coupled to the receiver of the firearm so that rounds of ammunition stored in the magazine can be fed into the chamber of the firearm. In addition, multiple spacers can be received within the cavity defined by the magazine housing, which spacers may be configured to change or alter a width, dimension, size, and/or configuration of the magazine housing to allow the magazine to store and feed various and/or different caliber, length, size, and/or types of ammunition.

16 Claims, 10 Drawing Sheets

(56) References Cited

U.S. PATENT DOCUMENTS

| | | | | |
|---|---|---|---|---|
| 4,139,958 | A | 2/1979 | Foote | |
| 4,484,403 | A | 11/1984 | Schwaller | |
| 4,864,758 | A | 9/1989 | Crossman | |
| 4,876,813 | A | 10/1989 | Tuma | |
| 5,027,541 | A | 7/1991 | Velezis | |
| 5,056,252 | A | 10/1991 | Velezis | |
| 5,329,718 | A * | 7/1994 | Howard | F41A 9/69 42/50 |
| 5,375,359 | A | 12/1994 | Chesnut et al. | |
| 5,452,533 | A | 9/1995 | Bentley | |
| 5,615,505 | A | 4/1997 | Vaid | |
| 5,638,626 | A | 6/1997 | Westrom | |
| 5,664,355 | A | 9/1997 | Ronkainen | |
| 5,704,148 | A | 1/1998 | Valorose | |
| 5,755,052 | A | 5/1998 | Keeney | |
| 5,761,841 | A | 6/1998 | Snick | |
| 5,870,846 | A | 2/1999 | Ledford | |
| 5,956,878 | A | 9/1999 | Yang | |
| 6,032,395 | A | 3/2000 | Bentley et al. | |
| 6,070,352 | A | 6/2000 | Daigle | |
| 6,257,115 | B1 | 7/2001 | Balsavage et al. | |
| 6,912,806 | B2 | 7/2005 | Malindretos | |
| 7,093,386 | B1 | 8/2006 | Vieweg | |
| 7,318,294 | B2 | 1/2008 | Zimmermann | |
| 7,444,775 | B1 | 11/2008 | Schuetz | |
| 7,533,483 | B1 | 5/2009 | Alzamora et al. | |
| 7,536,816 | B2 | 5/2009 | Weinberger | |
| 7,698,844 | B2 * | 4/2010 | Gruber | F41A 9/71 42/50 |
| 7,735,252 | B1 * | 6/2010 | Laney | F41A 9/71 42/49.02 |
| 7,866,079 | B2 | 1/2011 | Keeney et al. | |
| 7,958,660 | B2 | 6/2011 | Fitzpatrick et al. | |
| 8,028,455 | B1 * | 10/2011 | Battaglia | F41A 9/71 42/49.02 |
| 8,104,209 | B1 | 1/2012 | Bentley et al. | |
| 8,322,063 | B1 | 12/2012 | Battaglia | |
| 8,418,390 | B1 | 4/2013 | Wright | |
| 8,448,371 | B1 | 5/2013 | Wilhelm | |
| 8,522,465 | B2 | 9/2013 | Jarboe et al. | |
| 8,667,723 | B2 | 3/2014 | Bentley et al. | |
| 8,689,475 | B2 * | 4/2014 | Battaglia | F41A 9/65 42/49.02 |
| 8,756,846 | B1 | 6/2014 | Lemoine | |
| 9,103,612 | B2 | 8/2015 | Foster | |
| 9,115,951 | B2 | 8/2015 | Bentley | |
| 9,207,029 | B2 | 12/2015 | Klarborg | |
| 9,470,464 | B2 | 10/2016 | Kielsmeier et al. | |
| 9,523,546 | B1 * | 12/2016 | Harding | F41A 9/70 |
| 9,528,784 | B2 | 12/2016 | Roberts et al. | |
| 9,534,862 | B2 | 1/2017 | McNitt | |
| 9,784,512 | B1 * | 10/2017 | Harding | F41A 9/70 |
| 2006/0048426 | A1 | 3/2006 | Crandall | |
| 2008/0028659 | A1 | 2/2008 | Moretti | |
| 2010/0281743 | A1 | 11/2010 | Keeney et al. | |
| 2010/0307042 | A1 * | 12/2010 | Jarboe | F41A 3/18 42/6 |
| 2012/0198743 | A1 | 8/2012 | Bentley et al. | |
| 2013/0086834 | A1 * | 4/2013 | Battaglia | F41A 9/65 42/49.02 |
| 2013/0125439 | A1 | 5/2013 | Bentley et al. | |
| 2014/0250751 | A1 | 9/2014 | Foster | |
| 2015/0068096 | A1 | 3/2015 | Addis | |
| 2015/0075049 | A1 | 3/2015 | Klarborg | |
| 2015/0176938 | A1 | 6/2015 | Micklethwaite | |
| 2015/0198403 | A1 | 7/2015 | Bentley | |
| 2015/0362271 | A1 | 12/2015 | Foster | |
| 2016/0282071 | A1 | 9/2016 | Vilardi et al. | |
| 2016/0298918 | A1 | 10/2016 | Baker et al. | |
| 2016/0298919 | A1 | 10/2016 | Ballard | |

FOREIGN PATENT DOCUMENTS

| | | | |
|---|---|---|---|
| EP | 1660836 | B1 | 7/2010 |
| GB | 1401893 | A | 8/1975 |

* cited by examiner

MAGAZINE WITH SPACERS FOR ACCOMMODATING MULTIPLE CALIBER, SIZE AND/OR LENGTH ROUNDS

CROSS-REFERENCE TO RELATED APPLICATION

This application claims the benefit of U.S. Provisional Application No. 62/326,533, filed on Apr. 22, 2016.

INCORPORATION BY REFERENCE

The disclosure of U.S. Provisional Application No. 62/326,533, filed Apr. 22, 2016, is incorporated by reference herein as if presented in its entirety.

TECHNICAL FIELD

The present disclosure generally relates to firearms and, in particular, a reconfigurable magazine for firearms that accommodates multiple caliber, size, and/or length rounds.

BACKGROUND

Some firearms, such as modular or reconfigurable firearms, may be adapted to fire multiple caliber, different length, and/or different sized or configured rounds. For example, some military or tactical firearms are designed to be reconfigurable to fire .308, .338 or .300 Winchester Magazine ("Win. Mag.") rounds, which rounds may include belted and non-belted rounds, and consequently may require a differently configured magazine to store and feed the rounds into the chamber of the firearm. It therefore can be seen that a need exists for a reconfigurable magazine that accommodates such variably configured, sized, and/or caliber rounds to ensure proper storage of the rounds and reliable feeding thereof. The present disclosure addresses the foregoing and other related, as well as unrelated, issues in the art.

SUMMARY

Briefly described, the present disclosure generally relates to a firearm magazine that can be adapted to facilitate feeding of multiple different caliber or sized rounds of ammunition into the chamber of a firearm, the firearm typically having a receiver, a barrel mounted thereto defining a chamber, and a magazine well for receiving the magazine. The magazine generally includes a housing with front, rear and side walls that at least partially define a cavity or chamber for storing the rounds of ammunition therein. A magazine follower is biased, such as by a spring or other mechanism, upwardly through the housing to force or urge the rounds of ammunition toward an open top portion of the magazine. Feed lips generally will be arranged along the top portion of the magazine and can be configured to engage and guide the rounds of ammunition towards the chamber of the firearm, for example, upon engagement of a round by movement of the bolt of the firearm along the receiver. The magazine additionally may include multiple inserts or spacers sized, dimensioned or otherwise configured to be received within the cavity of the magazine housing. The spacers or inserts can be configured to change the dimensions, size, arrangement or configuration of the magazine to allow different/various types, caliber, and/or lengths of rounds of ammunition, including belted and non-belted rounds, to be stored therein and be fed into the firearm chamber.

With one aspect of this disclosure, the magazine can include a first or forward spacer and a second or rear spacer. The first spacer may generally include a body with a slot or guide surface defined therein for receiving the front ends or noses of the rounds of ammunition, as well as a front end of the magazine follower. The front end of the magazine follower also may be correspondingly sized, dimensioned, and/or configured to fit within the guide slot or surface of the spacer to stabilize the follower and facilitate reliable feeding of the rounds of ammunition. Alternatively, a front spacer may not be needed or used, and the front end of the magazine can be configured to be engaged by and guide the follower and/or the rounds.

The rear or second spacer will include a body with a groove or slot defined therein. The groove or slot will receive or otherwise interact with a protruding tab or other guide element or feature arranged along a rear end of the magazine follower, to help guide the follower along its vertical path of movement/travel, and to also stabilize the follower as it moves the rounds of ammunition towards the feed lips. The rear or second insert/spacer additionally may include one or more stop portions projecting from a top portion of its body. The stop will project or extend upwardly and can be sized to an extent as needed to prevent rounds from being displaced or otherwise shifted out of alignment as the bolt is moved along the receiver during cycling/action of the firearm.

For example, as the bolt is moved in a rearward direction after firing of the firearm, the bolt's stripping lug may contact a portion of the uppermost round of ammunition in the stack of rounds of ammunition stored within the magazine, such as the belt of a belted round of ammunition, which could potentially displace the round rearwardly and out of alignment such that the round cannot be properly loaded into the chamber or the bolt may get stuck on the belt round of ammunition thereby preventing cycling of the firearm. The stop portion can substantially retard or prevent such rearward movement or dislocation of the round of ammunition so that the bolt can continue its rearward motion to fully cycle and load a next round into the chamber.

The rear or second insert additionally may include one or more or tapered or sloped portions with corresponding guide surfaces that guide the rounds of ammunition as they are moved upwardly through the magazine.

Various features, objects and advantages of the present disclosure will become apparent to those skilled in the art upon a review of the following detailed description, when taken in conjunction with the accompanying drawings.

Figure 1A:
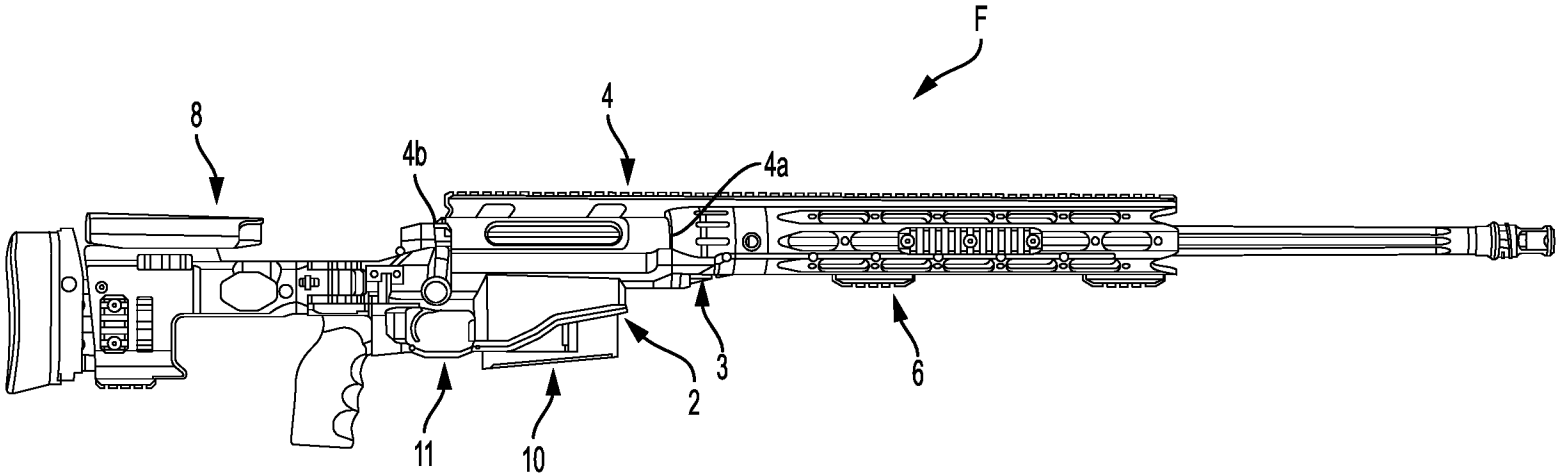
FIG. 1A provides a side view of a firearm according to principles of the present disclosure.

It will be understood that the drawings accompanying the present disclosure, which are included to provide a further understanding of the present disclosure, are incorporated in and constitute a part of this specification, illustrate various aspects, features, advantages and benefits of the present disclosure, and together with the following detailed description, serve to explain the principals of the present disclosure. In addition, those skilled in the art will understand that, accordingly, in practice, various features of the drawings discussed herein are not necessarily drawn to scale, and that dimensions of various features and elements shown or illustrated in the drawings and/or discussed in the following Detailed Description may be expanded, reduced or moved to an exploded position in order to more clearly illustrate the principles and embodiments of the present disclosure as set forth herein.

DETAILED DESCRIPTION

Referring now in greater detail to the drawings in which like numerals indicate like parts throughout the several views, the present disclosure generally relates to a magazine 10 that can be reconfigured or adapted to feed rounds of ammunition 100 into the chamber 3 of a firearm F, including various/different sizes, types, or caliber rounds of ammunition, including belted and non-belted rounds of ammunition. As shown in FIGS. 1B-8B, the magazine may include multiple inserts or spacers 80/160 sized, dimensioned and/or otherwise configured to be received within the housing 12 of the magazine to allow various sizes, types, and/or caliber rounds to be stored therein and fed into the chamber 3 of the firearm F.

Figure 1B:
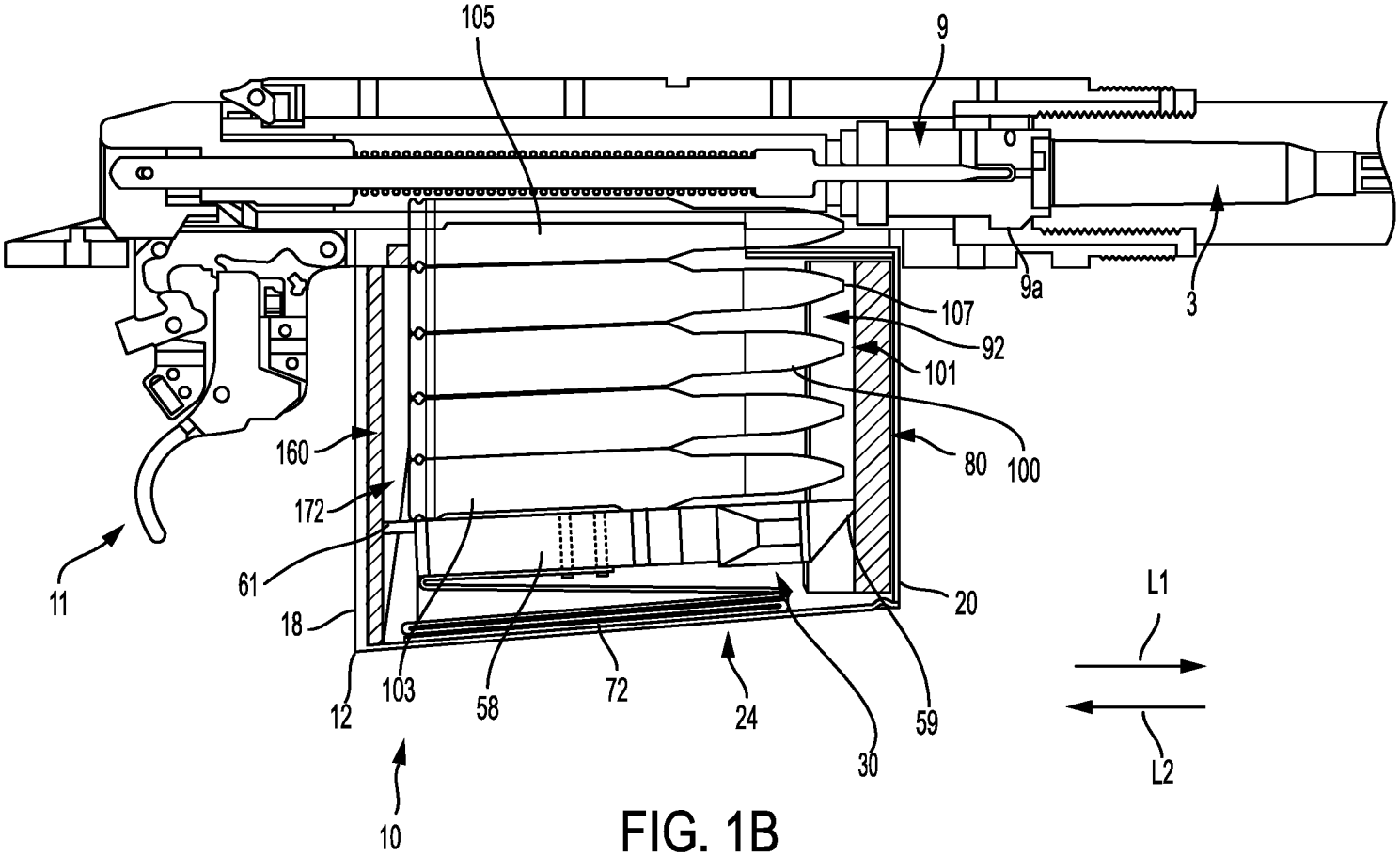
FIG. 1B shows a side view and partial cross-section showing an example magazine attached to the firearm of FIG. 1A.

As indicated in FIG. 1A, the magazine 10 is generally configured to be received within the magazine well 2 of a firearm F, which firearm F will include a receiver 4. A barrel assembly 6 is mounted to the receiver 4 at a front end 4*a* thereof and defines a chamber 3 at a position where the barrel assembly 6 connects to the receiver 4. A butt stock assembly 8 is mounted to a rear end 4*b* of the receiver 4. A bolt assembly 9 having one or more lugs is slidably received along the receiver 4 for operation of the firearm F, as generally shown in FIG. 1B. For example, a stripping lug 9*a* of the bolt assembly 9 may contact/engage a portion of the uppermost round of ammunition 100 stored in the magazine and force/urge the round toward and into the chamber 3. A fire control 11 may be mounted to the receiver 4 for controlling firing of the firearm F. The ammunition magazine 10 will be positioned or received within the magazine well 2 so as to supply the ammunition 100 stored therein to the receiver 4 such that the ammunition 100 can be fed to the chamber 3 of the firearm F.

Figure 4:
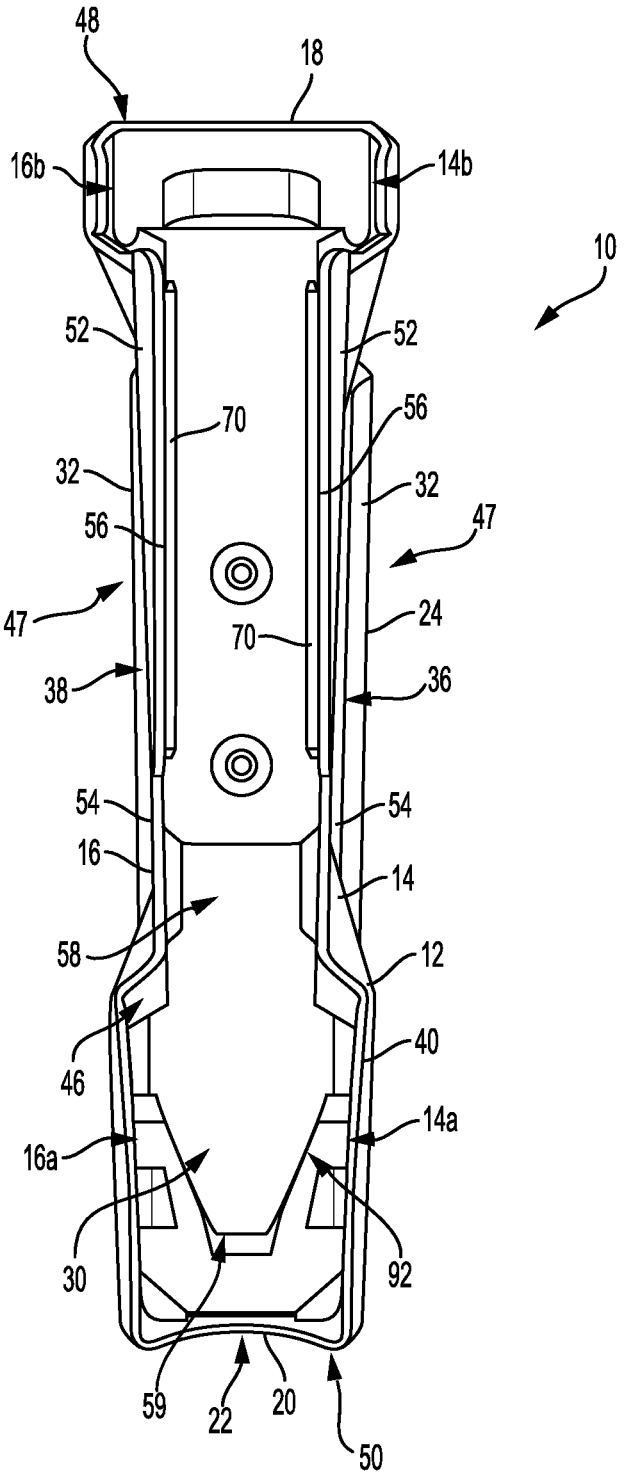
FIG. 4 provides a top view of the magazine shown in FIGS. 1A-B.

The magazine 10 can be adjustable and/or reconfigurable to accommodate rounds of ammunition of different lengths, sizes, and/or different calibers of ammunition within a specific caliber range, e.g., .308, .338, .300 Win. Mag., and/or other rounds, by way of one or more removable/interchangeable spacers or inserts 80 and 160 that are insertable/received within the cavity 30 of the magazine housing 12. In one aspect of this disclosure, as generally shown in FIGS. 1B and 4, a first or forward removable spacer/insert 80 may be at least partially fitted/received within the housing 12 along interior surfaces 14*a*/16*a* of sidewalls 14/16 at, near or adjacent to front wall 20 and a second or rearward, removable spacer/insert 160 may be at least partially fitted/received within the housing 12 along interior surfaces 14*b*/16*b* of sidewalls 14/16 at, near or adjacent to rear wall 18, which spacers/inserts 80/160 may reduce the interior dimensions or size of, such as the width, or otherwise alter the configuration/arrangement of the housing 12 to thereby permit the magazine 10 to accommodate rounds of ammunition 100 of a specific/predetermined caliber diameter or having different lengths, e.g., .308, .338 or .300 Win. Mag. rounds.

Figure 2:
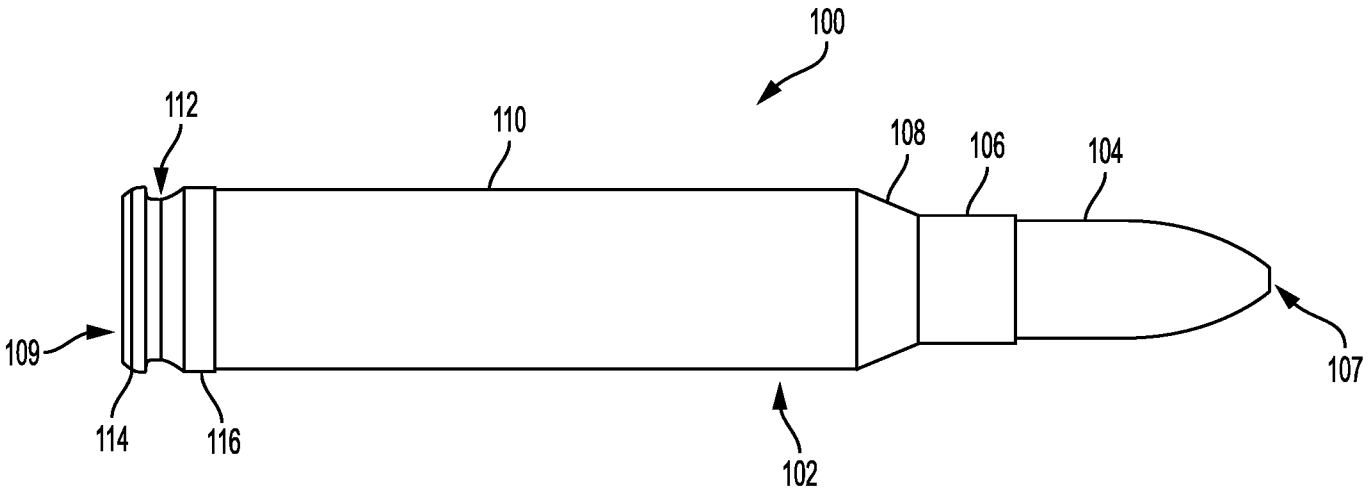
FIG. 2 shows a side view of one example round of ammunition.

The rounds of ammunition 100 may include, for example, belted rounds of ammunition, such as, e.g., belted .300 Win. Mag. rounds, such as, by way of example, shown in FIG. 2, although a variety of other rounds, including belted and non-belted rounds, also can be accommodated. FIG. 2 shows that a belted round of ammunition 100 may have a casing 102 with one or more projectiles 104 arranged therein. The casing 102 generally includes a neck portion 106 sized, crimped, or otherwise constrained about the projectile 104; a shoulder portion 108 having a tapered or bottleneck configuration and arranged proximate the neck portion 106; and cylindrical body 110 arranged proximate the shoulder portion 108. The casing 102 additionally may include an annular recess or groove 112 arranged along/defined in a rearward section of the cylindrical body 110 and an associated rim 114, and the annular recess 112 and rim 114 may be configured to facilitate ejection of a spent casing after firing. A belt 116 may be arranged along the cylindrical body 110 of the casing 102 adjacent or near the annular groove 112. A primer will be arranged within a primer chamber or cavity along the rear end 118 of the casing 102. The primer will ignite or initiate a propellant within a propellant chamber of the casing 102 upon firing to thereby discharge the projectile 104 from the firearm.

In one example embodiment shown in FIG. 1B, the magazine 10 can be a modular, interchangeable magazine that can be a center feed, single stack type magazine that feeds the rounds of ammunition 100 from a single stacked row or group 101. However, the magazine also could be otherwise constructed, such as a double stack type magazine that feeds rounds of ammunition from a pair of adjacently arranged rows or groups. The magazine 10 will generally comprise a magazine housing or body 12 with opposing side walls 14/16 and rear wall 18 and front wall 20 extending between and joining or otherwise connecting the side walls 14/16, as generally shown in FIGS. 1B, 3, 4 and 7. The housing 12 may be made of any suitable material, such as metal, polymer, or a composite material. The housing 12 may be formed in any suitable manner, such as by molding, welding, soldering, or brazing the walls of the housing 12 together.

Figure 3:
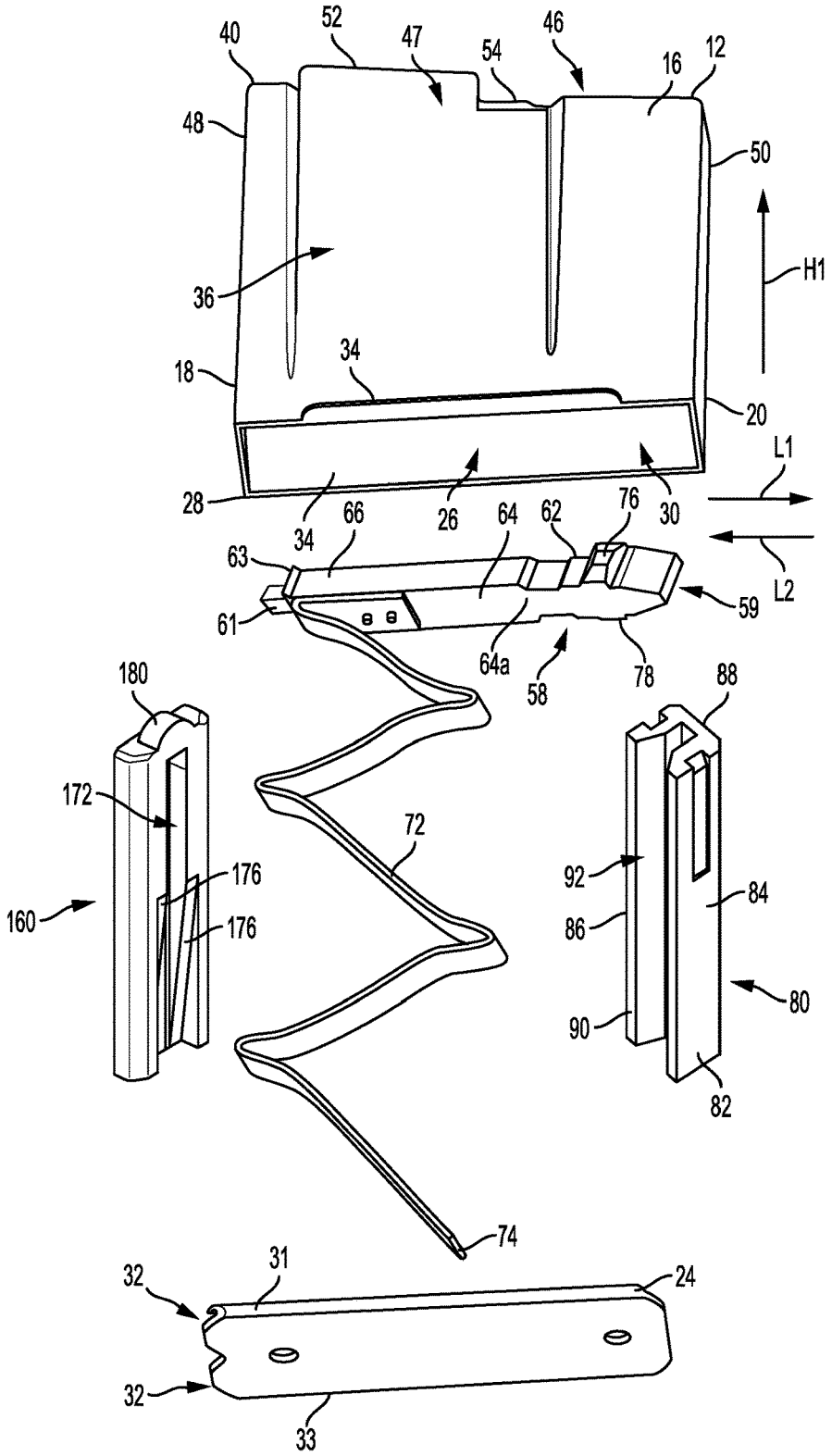
FIG. 3 shows an exploded side view of the magazine shown in FIGS. 1A-B.

Additionally, the magazine 10 can include a bottom plate 24 that encloses an opening or aperture 26 at the lower end 28 of housing 12 to define, along with the side walls 14/16 and front and rear walls 18/20, an interior space or cavity 30 sufficient to retain any number of rounds of ammunition 100. The bottom plate 24 can be removable/detachable from the magazine housing 12 to enable repair or replacement/reconfiguration of the components/parts held therein, such as by sliding or moving the bottom plate 24 in one direction off the magazine housing 12, and by sliding the bottom plate 24 rearwardly in an opposite direction onto the magazine body 14 to replace or reconnect it, as generally indicated in FIGS. 3 and 4. For example, the bottom plate 24 can have folded-over inward facing slots 32 on opposing sides 31/33 of the bottom plate 24 that are configured to slide onto tabs 34 extending outwardly from the lower edges of the housing side walls 14/16.

Figure 7:
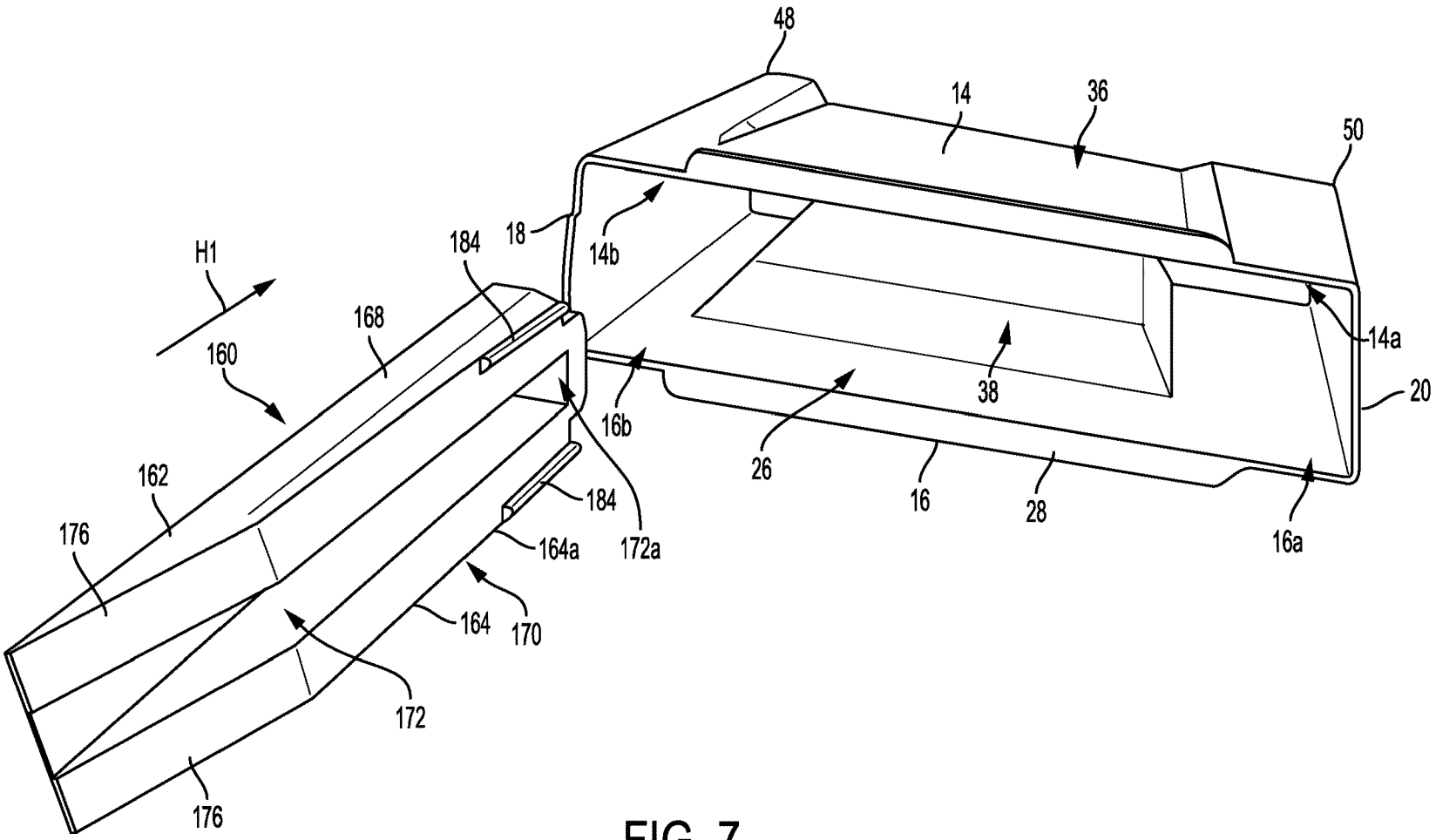
FIG. 7 shows an exploded view of the second spacer and the magazine of FIGS. 1A-B.

As further indicated in FIGS. 3-4, the sidewalls 14/16 can taper or narrow inwardly from a wider or greater spacing at the lower end 28 of the housing 12 to a narrower or smaller spacing at the upper end 40 of the housing 12. The spacing between the side walls 14/16 at the lower end 28 of the housing 12 may be selected such that the sidewalls are spaced at a distance substantially greater than the diameter of the rounds of ammunition, and may smoothly or gradually decrease to a spacing generally corresponding to the diameter of the rounds of ammunition at the upper end 40 of the housing 12 so as to provide a sliding fit between the sidewalls 14/16 and at least a portion of the rounds of ammunition 100 as they exit an opening or aperture 46 at the upper end 40 of the housing 12. The distance or spacing between the sidewalls 14/16 can be varied depending on the desired configuration of the stacking arrangement of the rounds of ammunition 100. For example, the rounds of ammunition 100 may be at least partially staggered from side-to-side toward the lower end 28 of the housing 12 and may be in a substantially straighter alignment toward the upper end 40 of the housing 12. The side walls 14/16 also can be angled or directed inwardly from the rear end 48 to the front end 50 of the magazine housing 12, as shown in FIG. 7, which slope or taper may correspond to a taper or slope of the rounds of ammunition 100. Tapered portions 36/38 also may extend along a middle or intermediate portion 47 of the housing 12 to retain or at least partially contact/engage the rounds of ammunition 100 along at least a portion of the cylindrical body 110 of the round casing 102.

The magazine 10 can include a pair of feed lips 52 that engage and guide the rounds of ammunition 100 as they are fed towards the chamber 3 of the firearm F, for example when the lug 9*a* of the bolt assembly 9 contacts or engages the rounds of ammunition so as to urge the contacted round in the forward direction, e.g., as shown by L1 in FIG. 1B, during cycling of the firearm F. The feed lips 52 may be positioned along and project from upper edges 54 of the side walls 14/16 as generally shown in FIGS. 3-4, and the feed lips 52 may be arranged along the tapered portions 36/38 of the sidewalls 14/16 and formed integrally therewith, though the feed lips 52 may be coupled to the housing 12 in any suitable manner. The feed lips 52 may extend inwardly toward each other over the opening 46 at the upper end 40 of the housing 12, and may have a curved or arcuate shape, though the feed lips 52 are not limited to any particular shape and may include any suitable shape or configuration. FIG. 4 further shows that the feed lips 52 may have substantially parallel edges 56 that are configured to contact and guide at least a portion of the rounds of ammunition (e.g., a portion of the cylindrical body 110 of the round casing 102) as they are fed towards the chamber 3, which edges 56 can be spaced apart at a distance selected for maintaining contact with at least a portion of the cylindrical body/case 110, of each round of ammunition 100 as the round is loaded into the chamber 3 of the firearm F. The feed lips 52 further may be configured to move or flex against the force of the rounds of ammunition 100, which may prevent jamming or sticking of the rounds as they are fed towards the chamber 3, as well as facilitate retention of the rounds within the magazine. The length of the feed lips 52 along the sidewalls 14/16 may be selected to generally correspond to a release point of the bolt 9 of the firearm F so the rounds can be presented for loading into the chamber 3, and the height of the feed lips 52 may be selected to permit sufficient clearance such that the lug 9*a* of the bolt 9 can move along the receiver 2 to urge/direct the rounds of ammunition 100 towards and into the chamber 3.

In some embodiments, a first or front spacer 80 may be received within the cavity 30 of the magazine 10 and arranged at, substantially near or substantially adjacent the front end/portion 50 of the magazine 10. FIGS. 3 and 4 show that the spacer 80 may include a guide surface or a groove or slot 92 arranged therealong dimensioned, sized, and/or configured to receive and at least partially engage/support a front portion 59 of the magazine follower 58. The groove or slot 92 also may at least partially receive and/or engage a nose or front end 107 of the rounds of ammunition 100. A second or rear end spacer/insert 160 further generally will be arranged at, near or adjacent a rear end 48 of the magazine housing 12. FIGS. 5, 6, 7, 8A, and 8B show that the second spacer 160 may include a slot or groove 172 arranged therealong and configured to receive a projecting tab 61 or other guidance feature or element arranged along rear end 58*b* of the magazine follower 58 so the tab 61 is moveable therealong, which arrangement/construction may stabilize the magazine follower 58 as the rounds of ammunition 100 supported thereon are moved into the chamber 3 and the follower 58 is urged in an upward direction or path of travel, e.g., in a direction H1. The second spacer 160 further may include a stop portion 180 configured to help retard displacement of the uppermost round of ammunition 105 of a stack of ammunition 101 held within the magazine housing 12 and supported by the follower 58 rearwardly, if the bolt 9, or lug 9*a* projecting therefrom, contacts or otherwise engages at least a portion, e.g., a belt 116, of the uppermost round of ammunition 105 as the bolt 9 is moved along the receiver 4 during cycling of the firearm F, and the second spacer 160 additionally may include one or more sloped or tapered guide surfaces 176 that at least partially engage a rear end 109 of the rounds of ammunition 100 so as to guide the rounds as they are urged upwardly (e.g., direction H1) by the follower 58 to facilitate feeding thereof.

The follower 58 of the magazine 10 is positioned within the cavity 30 of the magazine housing 12 between the sidewalls 14/16 and disposed or arranged over the bottom plate 24. The follower 58 may be in contact with, so as to at least partially support, the lowermost round of ammunition 103 in a stack of rounds 101 stored within the magazine 10 such that the follower 58 at least partially supports the stack of rounds of ammunition 101 (FIG. 1B). The follower 58 is also operable to bias or urge the rounds 100 upwardly, e.g., in direction H1, toward the feed lips 52. As shown in FIGS. 3, 4, 5, 8A, and 8B, the follower 58 generally will include a follower body 60 having top 62 and bottom 64 portions with sidewalls 66/68 extending therebetween. The follower 58 also can include a pair of longitudinal projections 70 arranged along a surface 62*a* of the top portion 62 of the follower 58. Projections 70 can extend along and at least partially support at least a portion of the cylindrical body 110 of lowermost 103 round of ammunition 100 in the stack 101 held within the magazine 10 to center and stabilize the round(s) of ammunition 100 as they are forced upwards, e.g., in direction H1 shown in FIG. 5. A follower spring 72 supported by the bottom plate 24 may be connected to a surface 64*a* of the bottom portion 64 of the follower 58 to bias or force the follower upward towards the top end 40 of the magazine housing 12. The spring 72 and the bottom plate 24 may have corresponding projections/recesses to position an end 74 of the spring 72 at a predetermined location along the bottom plate 24. The follower 58 may be made of a plastic, polymer, or other composite material, such as a heat-resistant molded polymer, though the follower 58 can comprise any suitable material without departing from the present disclosure.

Figure 8A:
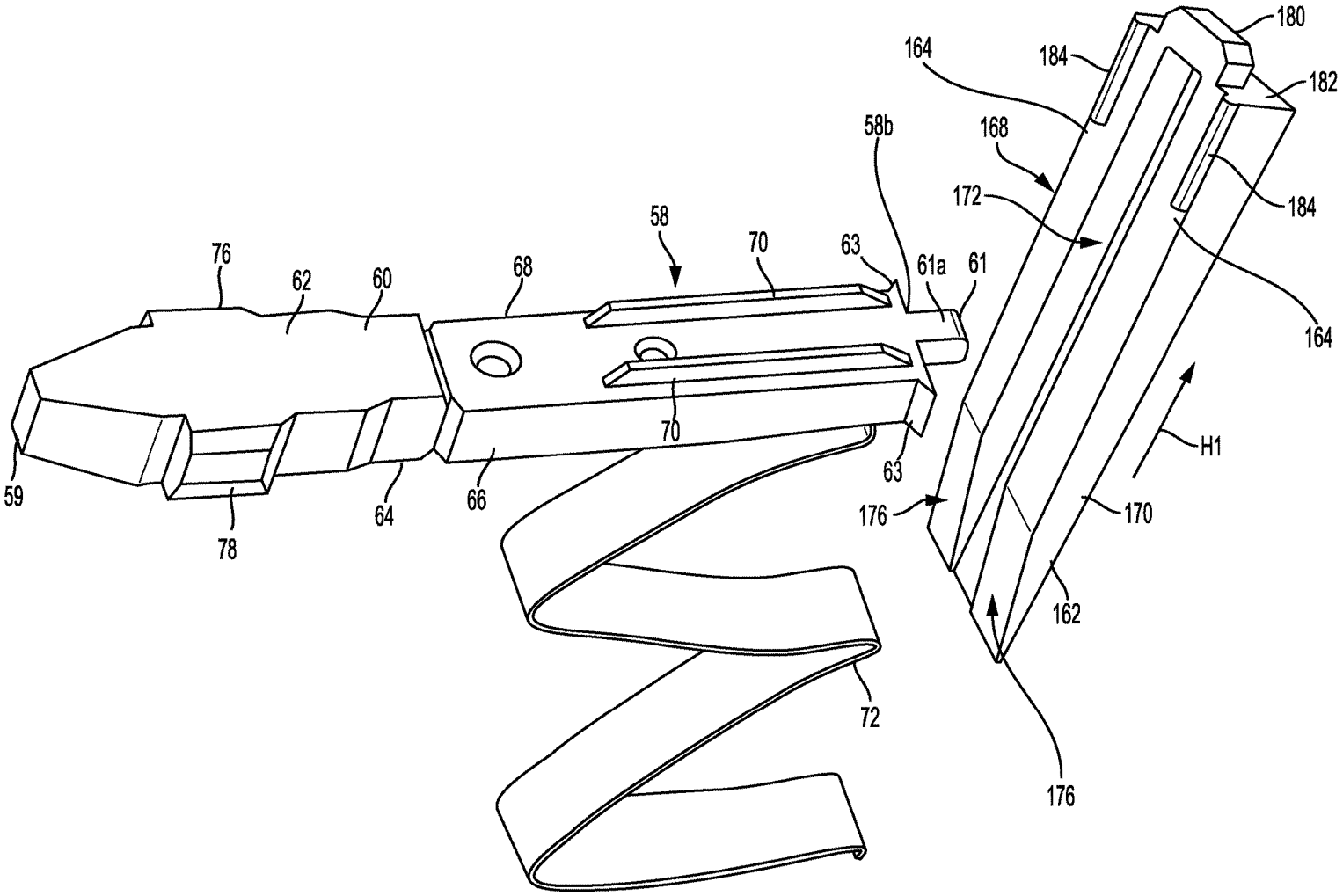
FIGS. 8A-8B illustrate perspective views of the follower and second spacer of the magazine of FIGS. 1A-B.
Figure 8B:
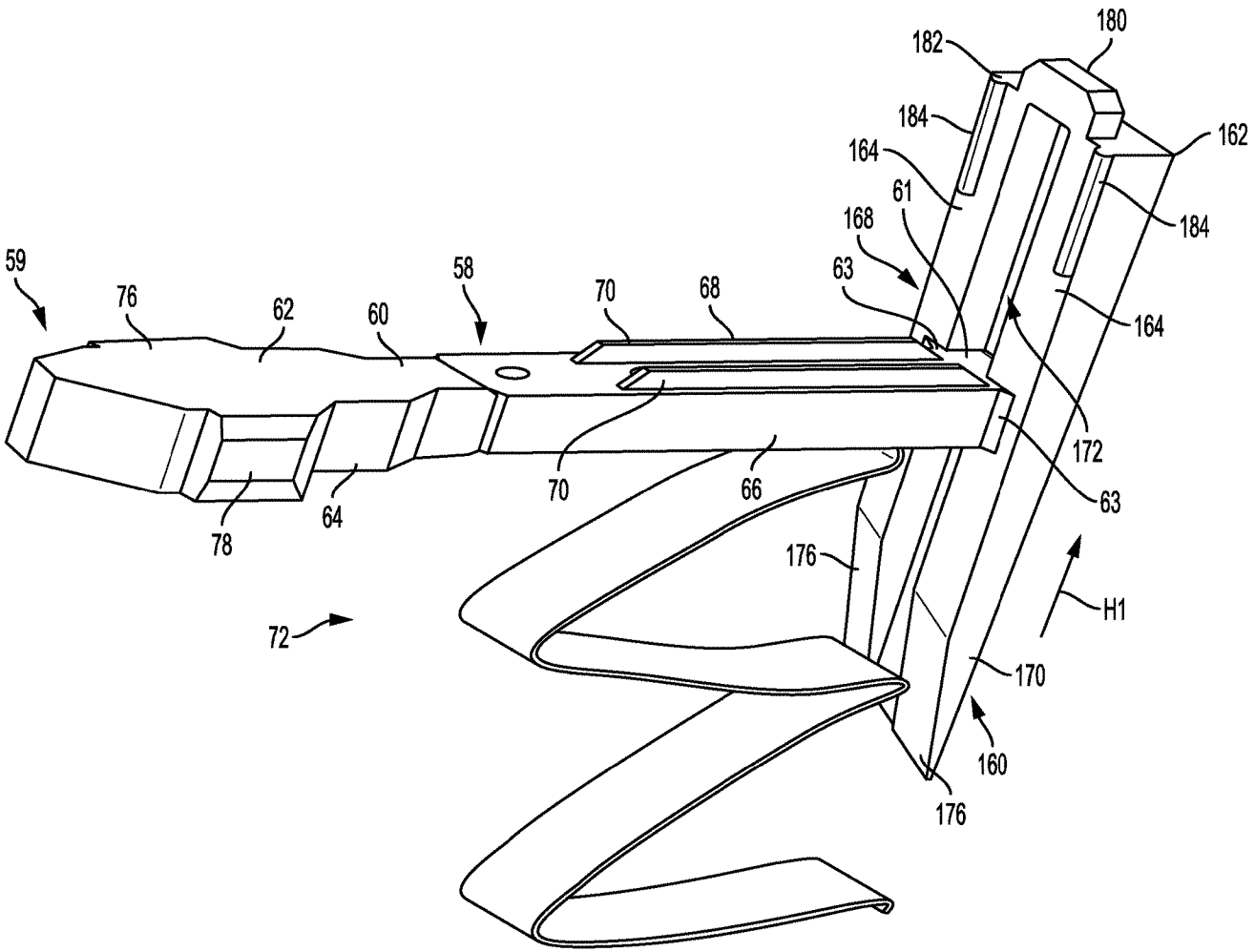

The front portion 59 of the follower body 60 may be shaped, sized, dimensioned, and/or otherwise configured to be received within the groove or slot 92 formed along the forward or first spacer 80. However, the front portion 59 of the follower body 60 can engage and be guided along a front end portion of the magazine in embodiments without a front spacer. In one example, as generally shown in FIGS. 4, 5, 8A and 8B, the front portion 59 of the follower 58 may be generally V-shaped or wedge-shaped so as to be at least partially received within groove 72 and slidable therealong, e.g., in directions H1/H2 shown in FIG. 5. The follower 58 additionally may include one or more guide projections, e.g., projections 76/78, positioned adjacent or near the front portion 59 of the follower 58, to stabilize and guide the follower 58 as it is forced/moved upwards and along groove 92 to feed the rounds of ammunition 100. The follower 58 may further include a tab 61, other protrusion and/or guidance element or feature arranged along a rearward end 58*b* of the follower that is configured to be received within a corresponding groove or slot 172 defined in or otherwise provided along a body 162 of the second or rear spacer 160, as generally shown in FIGS. 8A-8B. The tab 61 may be in a sliding arrangement with one or more interior surfaces of the slot/groove 172 to thereby provide stability to the follower 58 as it is moved upward to feed the rounds of ammunition 100. The tab 61 may take on a generally square or rectangular shape, though the tab 61 may have any suitable shape to fit within and engage the slot/groove 172 as described. The follower 58 also may have a series of protuberances or projections 63 arranged/formed along sidewalls 66/68 near or adjacent the rearward end 58*b* to further stabilize the follower 58.

Figure 5:
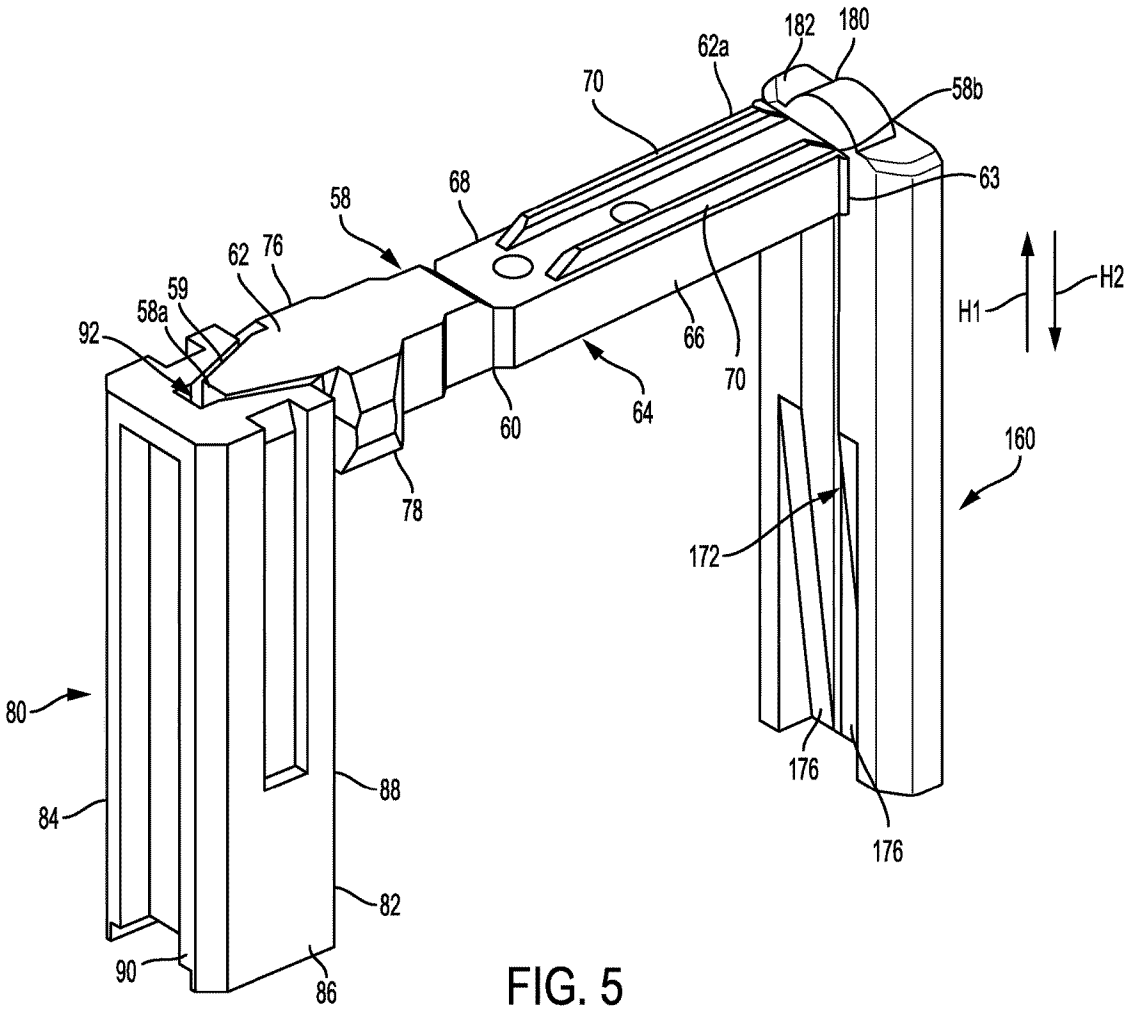
FIG. 5 shows a perspective view showing first and second spacers and a follower of the magazine shown in FIGS. 1A-B.

FIG. 5 shows an example of a first or forward spacer 80, which can include a body 82 having sidewalls 84/86, with a front 88 and rear 90 walls extending therebetween. The insert/spacer 80 may be made of a plastic, polymer, or other composite material, such as a heat resistant molded polymer or other suitable material. The spacer 80 also may be sized, dimensioned, and/or configured to be at least partially inserted into and moved upward through the lower opening 26 of cartridge housing 12 so as to have a sliding fit within the interior surfaces 14/*a*/16*a* of the sidewalls 14/16. Alternatively, a reinforcing member, which may be formed from a sheet material, e.g., metal, may be fitted in sliding contact within the housing 12 at, near, or adjacent to the front wall 20, e.g., within interior surfaces 14*a*/16*a*, to provide increased strength to the magazine housing 10, and the forward insert/spacer 80 may be sized, dimensioned, and/or configured to slide in or otherwise be received at least partially within such a reinforcing member. The body 82 of the spacer 80 additionally may have a recess, groove, slot or channel 92 defined in or extending along a surface of the rear wall 90 of the spacer 80, which faces towards the rear wall 18 of the housing 10, and the slot or channel 92 may be configured to receive and at least partially engage a front end/nose 107 of the rounds of ammunition 100 and/or the front portion 59 of the magazine follower 58, as generally shown in FIG. 1B. The slot or channel 92 may be sized, dimensioned or otherwise configured to permit the rounds of ammunition 100 to slide freely as they are fed upward, e.g., in direction H1, by the follower 58. Additionally, as described, the front portion 59 of the follower 58 may be shaped or configured to fit, e.g., having a wedge or other shape dimensioned to fit within the slot 92 and be slidable therealong as the follower 58 urges/moves the rounds 100 upward.

Figure 6:
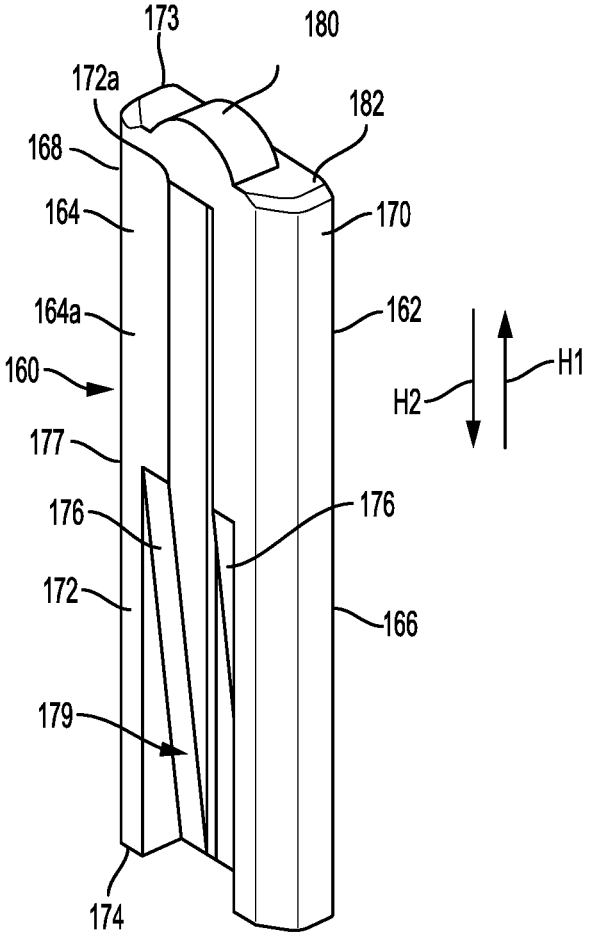
FIG. 6 provides a perspective view of the second spacer shown in FIG. 5.

FIG. 6 shows one example of a rear or second spacer/insert 160, which can generally include a body 162 having opposing front 164 and rear walls 166, with side walls 168 and 170 extending therebetween. The side walls 168/170 may have beveled or rounded portions/sections as generally shown in FIG. 6. In addition, a groove or slot 172 may be defined in a surface 164*a* of the front wall 164 of the insert/spacer 160. The groove or slot 172 may extend along the front wall 164 of the spacer 160, e.g., in a direction H1, and may be sized, dimensioned and/or configured to receive the guidance feature or tab 61 arranged along/projecting from the rearward end 58*b* of the magazine follower 58. The guidance feature or tab 61 may be slidable or moveable along groove or slot 172 so as to prevent an undesired movement of the follower 58 relative to the magazine housing 12, e.g., rotation or transverse movement of the follower 58, so as to stabilize the follower 58 as the follower 58 moves the rounds of ammunition 100 in the upward direction, e.g., H1, as generally shown in FIGS. 8A-B. As shown in FIG. 7, the groove 172 may terminate in an interior surface 172*a* that may contact or engage a top surface 61*a* of the tab 61 when the tab 61 reaches or is substantially near or substantially adjacent to a top end 40 of the magazine housing 12.

The rear spacer 160 may further include guide surfaces 176 that are tapered or sloped and configured to guide or engage a rear end 109 of the rounds of ammunition 100 when the rounds are moved upwardly, e.g., in direction H1, by the follower 58. The tapered portions 176 may begin/initiate at a middle or intermediate portion 177 (between the upper and lower ends 173/174 of the spacer 160) along the front wall 164 which portions may narrow, taper or be chamfered so as to reduce a thickness of the spacer 160 along the direction H2, for example, the spacer may have a greater or maximum thickness at the intermediate portion 177 and a reduced or minimum thickness at the end portion 174 of the spacer 160. The tapered portions 176 may extend from the notch or recess 176 all the way to the side walls 168/170 of the spacer 160 or may be disposed or arranged within a cutout or recessed portion 179 defined in the front wall 164 and such that the tapered portions 176 do not extend all the way to the side walls 168/170 of the spacer 160. The tapered portions 176 may reduce the width/thickness of the sidewalls 168/170 of the spacer 160 in the L1/L2 directions (FIG. 3), e.g., to allow for expansion of the spring 72 (e.g., in the L1/L2 directions) when the magazine 10 is fully or partially loaded. For example, with the magazine 10 fully loaded, the spring 72 may be compressed such that it has a maximum width in the L1/L2 directions, and the spring's width may decrease as the rounds 100 are fed and the spring is released to move the follower 58 upward in the H1 direction. As such, to prevent the spring 72 from getting caught or wedged between the spacers 80/160 the tapered portions 176 can allow for expansion of the spring 72 with the magazine 10 fully or partially loaded.

The spacer 160 additionally may include a stop portion 180 arranged along a top surface 182 of the body 162 of the spacer 160, which stop portion 180 may be arranged and configured to prevent misalignment or displacement of the rounds of ammunition 100, as the lug 9*a* of the bolt 9 is returned or moved in a rearward direction (e.g., direction L2 in FIG. 1B) during action/cycling of the firearm F. For example, when belted rounds of ammunition, such as 300 Win. Mag. rounds, are loaded into the magazine 10, if the lug 9*a* of the bolt assembly 9 contacts the belt 116 of the casing 102 as the bolt 9 is moved rearwardly during cycling of the firearm F, the stop 180 may engage or contact a rear end 109 of the round so as to substantially retard or prevent rearward movement of the round if lug 9*a* were to get stuck on or otherwise catch on the belt 116. With the rearward movement of the round of ammunition restricted by the stop portion 180, the round may be forced downwardly, e.g., in direction H2, allowing the lug 9*a* to move/slide over the belt 116 so that the bolt 9*a* can complete its action/cycle and the round of ammunition 100 can be loaded into the chamber 3 of the firearm F. This stop 180 may have a generally semicircular shape, as is generally shown in FIG. 6; however, any suitable shape or configuration is possible, such as a stop comprising a substantially square, rectangular, or polygon shape and/or multiple projections or other portions extending/projecting from the top surface of the spacer 160 sufficient to retard undue rearward movement of a round 100. The spacer 160 additionally may include a pair of flanges or projecting portions 184 arranged/formed along the front wall 164 of the spacer 160 near or adjacent the top end 182 which may contact and stabilize the follower 58 when it is near or proximate the top portion 182 of the spacer 160.

The magazine 10 generally can be configured to accommodate a specific type/caliber of ammunition, e.g., .308, 0.339 Lapua Mag. and/or .308, .338 or .300 Win. Mag. rounds, and/or any other suitable rounds of ammunition, when the spacers 80/160 are installed in the magazine housing 12. Conversely, the magazine 10 can be configured to accommodate longer/different length ammunition when the spacers 80/160 are removed from the magazine housing 12. It is further envisioned that the spacers 80/160 can be interchangeable with other spacers of different configurations to accommodate other ammunition of various lengths/sizes and/or types/calibers. Additionally, the magazine 10 may be interchanged with other magazines configured to accommodate ammunition cartridges of different calibers and/or lengths. Though specific rounds, e.g., belted .300 Win Mag., are discussed above, any type/length/caliber or round of ammunition can be used with the magazine 10 and spacers 80/160 described herein, such as, for example, any rounds in the Win. Mag. family, 7 mm Remington Mag. rounds, Remington Ultra Mag. rounds, and/or Norma Mag. rounds.

To load the magazine 10, the front and rear spacers 80/160 may be inserted into lower opening 26 of the magazine housing 10. Subsequently, the rounds 100 can be fed into the lower opening 26 in a generally vertically stacked arrangement within the housing 12 until it is filled to feed lips 52. The follower 58 with spring 72 can then be inserted into the magazine housing 12. Afterwards, the magazine 10 can be clipped to the firearm F as described below, and the spring-loaded follower 58 can urge the rounds upward towards the feed lips 52 to allow the bolt 9 to feed the rounds 100 into the chamber 3. A spring-loaded magazine release button can be provided for selectively locking the magazine 10 in the magazine well 2 and releasing the magazine 10 from the magazine well 2 (not shown). Specifically, when the magazine is inserted in the magazine well, the spring-loaded release button can be biased into engagement with a locking aperture, which is positioned in a rear wall of the magazine well, adjacent the receiver and above a trigger guard of the firearm F. The spring-loaded release button can be depressed to disengage the locking aperture and allow the magazine 10 to be removed from the magazine well 12.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A reconfigurable magazine for a firearm that facilitates accommodation of rounds of ammunition of different length, size, caliber, and/or type, the reconfigurable magazine comprising:

a housing comprising a front portion, a rear portion, and side portions that at least partially define a cavity configured to receive the rounds of ammunition therein;

a follower arranged at least partially within and movable along the cavity of the magazine, wherein the follower is biased to guide the rounds of ammunition toward the firearm;

a plurality of removable spacers configured to be at least partially received within the cavity of the housing, the plurality of spacers comprising:

a first spacer configured to be positioned along the front portion of the housing of the magazine, the first spacer at least partially engaging a front portion of the rounds of ammunition; and a second spacer configured to be received along the rear portion of the housing of the magazine in a substantially spaced arrangement in relation to the first spacer, the second spacer at least partially engaging a rear portion of the rounds of ammunition, and comprising a body with a groove defined therealong, wherein the groove is configured to receive a guidance feature of the follower as the follower is moved along the cavity of the magazine.

2. The reconfigurable magazine of claim 1, wherein the at least a portion of the follower includes a tab extending from a body of the follower that stabilizes and/or aligns the follower as it guides the rounds of ammunition toward the firearm.

3. The reconfigurable magazine of claim 1, wherein the first spacer includes a groove defined therealong, wherein the groove is configured to receive at least a portion of the follower.

4. The reconfigurable magazine of claim 3, wherein the at least a portion of the follower includes a front end of the follower, wherein the front end of the follower includes one or more slanted surfaces that are configured to at least partially engage one or more corresponding slanted surfaces defined by the groove in the first spacer.

5. The reconfigurable magazine of claim 1, wherein the rounds of ammunition comprise one or more belted rounds of ammunition.

6. The reconfigurable magazine of claim 5, wherein the second spacer comprises a stop portion positioned therealong to substantially retard displacement of the one or more belt rounds of ammunition in at least one direction when a portion of a bolt of the firearm engages a belt of the one or more belted rounds of ammunition.

7. The reconfigurable magazine of claim 1, wherein the second spacer includes one or more sloped portions extending at least partially along a forward facing surface of the second spacer.

8. The firearm of claim 1, wherein the rounds of ammunition comprise .308 Norma Mag, .338 Lapua Magnum, 7 Remington on Magnum, 7 mm Remington Ultra Magnum, .338 Federal and/or .300 Winchester Magnum rounds.

9. A firearm, comprising:

a receiver;

a barrel coupled to a front end of the receiver and at least partially defining a chamber;

a magazine comprising a housing that includes a front portion, a rear portion, and side portions least partially defining a cavity configured to receive rounds of ammunition therein, and a biased follower arranged at least partially within the cavity, wherein the magazine is configured to be received within a magazine well in communication with the receiver for feeding of the rounds of ammunition received in the cavity into the chamber of the firearm; and one or more interchangeable first spacers and one or more interchangeable second spacers each at least partially received within the cavity defined by the housing of the magazine and each configured to enable alteration of a width, dimension, size, and/or configuration of the housing of the magazine to facilitate storage and feeding of rounds of ammunition having a different length, size, type and/or caliber, wherein the one or more first spacers are positioned adjacent a forward portion of the magazine, and the one or more the second spacers are positioned along a rearward portion of the magazine in a substantially spaced relationship from the one or more first spacers, and include a stop portion arranged at an upper end thereof and configured to substantially restrict displacement of the rounds of ammunition during cycling of the firearm, and wherein the one or more second spacers have a body that includes a groove defined therealong that is configured to at least partially receive and at least partially engage a tab extending from a body of the follower to stabilize and/or align the follower as it feeds the rounds of ammunition into the receiver of the firearm.

10. The firearm of claim 9, wherein the one or more first spacers have a body with a groove defined therealong that engages at least a portion of the follower and/or at least a portion of the rounds of ammunition.

11. The firearm of claim 9, wherein the rounds of ammunition include one or more belted rounds of ammunition.

12. The firearm of claim 9, wherein the one or more second spacers include one or more sloped surfaces defined along a forward portion thereof.

13. The firearm of claim 9, wherein the one or more second spacers include a pair of flanges arranged substantially adjacent to a top portion thereof that at least partially engage at least a portion of the follower to stabilize and/or align the follower as it approaches the top portion.

14. A magazine for a firearm, comprising:

a magazine housing that at least partially defines a cavity for receiving rounds of ammunition;

a follower arranged within the cavity of the magazine housing, the follower operable to guide and/or urge the rounds of ammunition along the cavity and toward a chamber of the firearm; and a plurality of spacers at least partially arranged within the cavity of the housing and configured to change a width, dimension, size, and/or configuration of the magazine to facilitate storage and feeding of rounds of ammunition of different caliber, length, size, and/or type, the plurality of spacers including a front spacer configured to be slidingly received within the cavity of the magazine housing adjacent a front wall of the magazine housing and having a channel along which a front portion of the rounds of ammunition are moveable, and a rear spacer configured to be received within the cavity of the magazine housing adjacent a rear wall of the magazine housing and having at least one guide surface adapted to engage a rear position of the rounds of ammunition as the rounds of ammunition are moved upwardly along the magazine housing by the follower, wherein the rear spacer includes a groove along a front wall thereof, and the groove is configured to receive a guidance feature of the follower as the follower is moved along the magazine housing.

15. The magazine of claim 14, wherein the rounds of ammunition comprise belted or non-belted rounds of ammunition.

16. The magazine of claim 14, further comprising a bottom plate releasibly mountable to the magazine housing in sliding engagement therewith.

* * * * *